United States Patent [19]

Wada et al.

[11] 4,040,696

[45] Aug. 9, 1977

[54] ELECTRIC DEVICE HAVING ROTARY CURRENT COLLECTING MEANS

[75] Inventors: Yukio Wada; Yoshinori Abura; Takeshi Matsui, all of Hikone, Japan

[73] Assignee: Matsushita Electric Works, Ltd., Osaka, Japan

[21] Appl. No.: 679,661

[22] Filed: Apr. 23, 1976

[30] Foreign Application Priority Data

Apr. 30, 1975 Japan ..... 50-52948

[51] Int. Cl.[2] ..... H01R 39/00

[52] U.S. Cl. ..... 339/8 R; 339/101; 339/182 RS

[58] Field of Search ..... 339/8 R, 8 P, 101, 182 RS

[56] References Cited

U.S. PATENT DOCUMENTS

| | | | |
|---|---|---|---|
| 3,950,052 | 4/1976 | Walter et al. | 339/8 R |
| 3,957,331 | 5/1976 | Tantillo et al. | 339/8 R X |

*Primary Examiner*—Roy Lake
*Assistant Examiner*—DeWalden W. Jones
*Attorney, Agent, or Firm*—Leydig, Voit, Osann, Mayer & Holt, Ltd.

[57] ABSTRACT

An electric device having rotary type current collecting means through electric source cord which is made freely rotatable with respect to variations in using position of the device for preventing any twist of the cord. The means comprises an integral block of a first carrier of current feeding conductor connected to the cord and a second carrier of current collecting conductor slidably contacting with the current feeding conductor of the first carrier for current collection from the cord to the electric device, the first and second carriers are rotatably coupled to each other and the integral block is assembled in the device body so as to stationarily hold the second carrier while the first carrier and cord are rotatably held with respect to the second carrier and device body.

20 Claims, 11 Drawing Figures

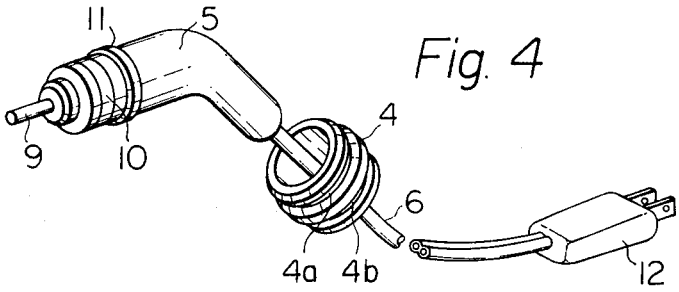
Fig. 4
Fig. 6
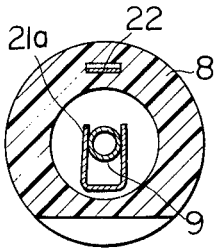
Fig. 7
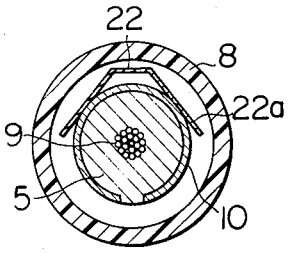
Fig. 5
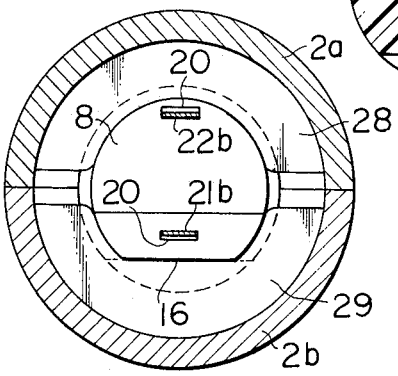
Fig. 8A
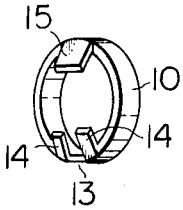
Fig. 8B
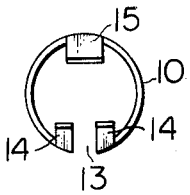
Fig. 9
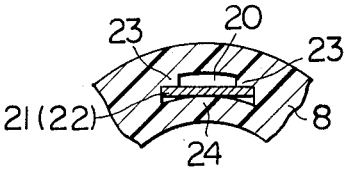
Fig. 10
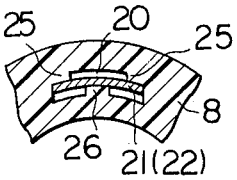

ELECTRIC DEVICE HAVING ROTARY CURRENT COLLECTING MEANS

This invention relates to electric devices having rotary current collecting means and, more particularly, to improvements in the current collecting assembled to electric devices in rotatable manner.

Heretofore, in the electric devices provided with a rotary current collecting means of this kind, that is, those current collecting means which holding a current source cord in a manner freely rotatable with respect to the electric device while aways maintaining the feed of a current to a load within the electric device, the rotary current collecting means is, as shown, for example, in Japanese Utility Model Application Laid-Open No. 77185/1973 and Japanese Utility Model Publication No. 4672/1970, incorporated in the electric device body and a part of said device is made a part of component members of the current collecting means, and such various performances as, for example, the smoothness of the rotating operation, the degree of the electric contact and the like are to be tested with all the component members of the electric device and rotary current collecting means as completely assembled. Therefore, in the conventional electric devices, there have been defects that, in case the performances are found not favorable as a result of such test, the electric device body will have to be disassembled and then assembled again and, even if the results of the test are favorable, it is unable to confirm whether the arrangement of respective components is not good enough as the rotary current collecting means is assembled in a blind state as hidden inside the device body so that no perfect safety from any troubles will be able to be guaranteed. Further, in the conventional devices, a part of the electric device is made a part of the component members of the rotary current collecting means as described in the foregoing and, therefore, the assembling workability of the current collecting means has been low and, for the same reason, required repair for removing any troubles has been complicated. The present invention has been suggested to remove these defects in the conventional devices.

In the present invention, a rotary current collecting means as a single block is formed of a current feeding conductor carrier carrying a current feeding conductor of the current source cord and a current collecting conductor carrier rotatably coupled to the current feeding conductor carrier while carrying a current collecting conductor always in contact with said current feeding conductor and such single block current collecting means is incorporated in an electric device body so that said defects are successfully solved.

A primary object of the present invention is to provide an electric device having a rotary current collecting means in which the performances of the current collecting means are enabled to be regardless to the electric device or its device body by preparing the rotary current collecting means as a single unit independent of the device body.

Another object of the present invention is to provide an electric device having a rotary current collecting means which is high in the assembling workability and can be produced at a lower cost.

A further object of the present invention is to provide an electric device having a rotary current collecting means which is excellent in the electric contact.

Another object of the present invention is to provide an electric device having a rotary current collecting means which is smooth in the rotating operation performed between the electric device and a current source cord.

A yet further object of the present invention is to provide an electric device provided with a rotary current collecting means in which any trouble can be judged from outside.

The present invention shall now be explained in the followings with reference to a preferred embodiment shown in the accompanying drawings, in which:

FIG. 4 is a perspective view of a current feeding conductor carrier, a current source cord and a sliding coupling member with respect to the electric device body of the current collecting means in FIG. 2;

FIGS. 5 to 7 are sectioned views of the current collecting means respectively taken on lines V – V′, VI – VI′ and VII – VII′ in FIG. 2;

FIGS. 8A and 8B are respectively a perspective view and elevation of one of current feeding conductors used in the means shown in FIG. 2;

FIG. 9 is a fragmentary sectioned view showing an example of fixing manner of a current collecting conductor to a current collecting conductor carrier; and FIG. 10 is a sectioned view similar to FIG. 9 showing another example of the fixing manner.

Figure 1:
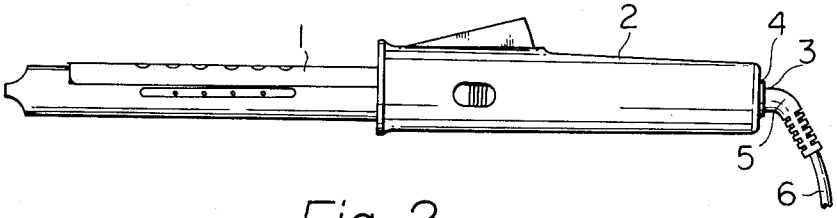
FIG. 1 is an elevation showing an entire hair iron shown as an embodiment of an electric device provided with a rotary current collecting means of the present invention.

Referring to hair iron shown in FIG. 1 as an embodiment of the electric device having the rotary current collecting means of the present invention, a current feeding conductor carrier 5 rotatable with respect to device body 2 through a ring-shaped sliding coupling member 4 and a current source cord 6 integral with the carrier 5 are led out of an opening 3 at an end in axial direction of the device body 2 which having a hair treating part 1 projected at the other end in the axial direction of the body 2.

Figure 2:
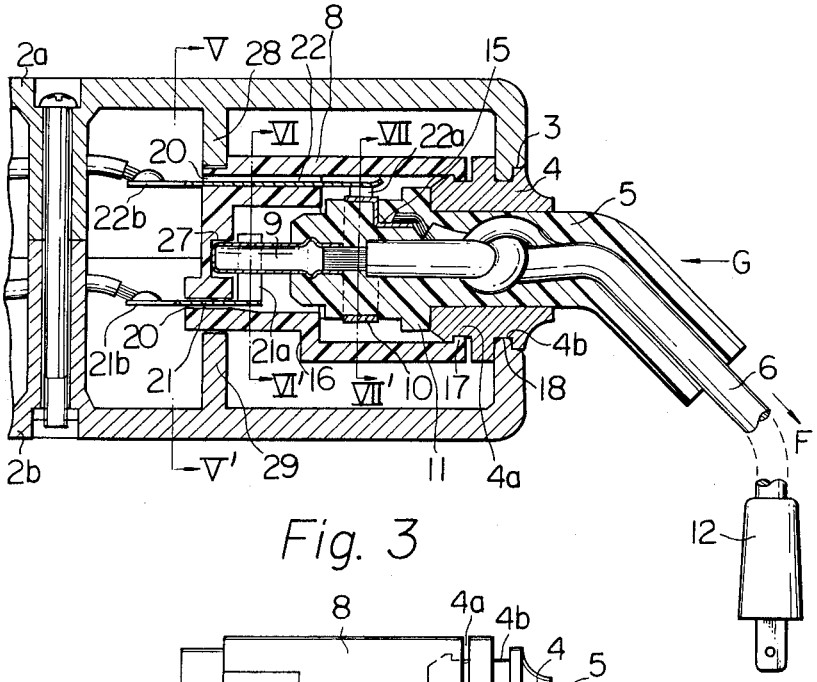
FIG. 2 is a partial sectioned view showing as magnified the rotary current collecting means in the device of FIG. 1.
Figure 3:
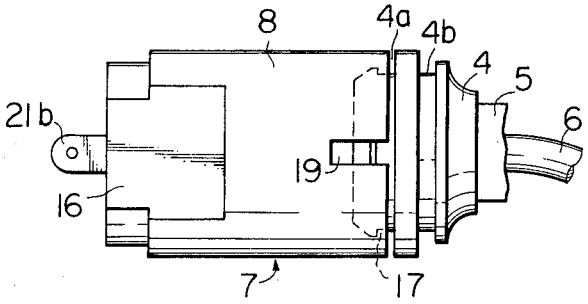
FIG. 3 is an elevation of the current collecting means of FIG. 2 as disassembled from the device and seen from the bottom in FIG. 2.

Referring further to the rotary current collecting means of the present invention with reference to FIGS. 2 and 3, the rotary current collecting means is formed as a single block 7 of the current feeding conductor carrier 5 and a current collecting conductor carrier 8. The current feeding conductor carrier 5 is formed of such electric insulator as preferably a soft plastic material to include a pin-shaped first current conductor 9 projected from one end in the axial direction of a substantially cylindrical barrel part, of the carrier, a substantially cylindrically formed second current feeding conductor 10 fitted to the outer periphery of the substantially middle part of the barrel part and a peripheral projection 11 formed as projected in the form of a ring on the other end side of the conductor 11 in said axial direction for engaging in ring-shaped sliding coupling member 4. A groove **4*a* for fitting therein the current collecting conductor carrier 8 and a groove 4*b* for fitting therein the device body 2 as will be later discribed are made on the outer periphery of the sliding coupling member 4. The first and second current feeding conductors 9 and 10 are electrically connected to respective lead wires of the current source cord 6. The cord 6 is molded in the part integrally with the current feeding conductor carrier 5 together with both of the current feeding conductors 9 and 10 so as to be embedded along the axis of the carrier 5 and led out of the other end thereof. A plug 12 to be connected with a current source is fixed to the tip of this current source cord 6. The sliding coupling member 4 is fitted over the carrier 5 from the said other end side thereof so as to be frictionally fixed onto the outer peripheral barrel part as engaged with the ring-shaped projection 11. The carrier 5 is bent at the other end side in a direction forming an angle with the axis of the carrier in a position slightly spaced from the position of the fixing the sliding coupling member 4, so that the rotation of the cord 6 and carrier 5** will be thereby made smooth.

As shown in FIGS. 8A and 8B, the second current feeding conductor 10 is formed by cylindrically bending an elongated rectangular conductive metal plate to provide a gap 13 between both ends and is provided with bent parts 14 at the both ends as bent inward of the cylinder and a terminal 15 at a position diametrally opposed to the gap 13 as bent inward for connection with a lead wire of the cord 6.

This second current feeding conductor 10 is fitted to said carrier 5 by being molded together with the carrier 5 so that the bent parts 14 and the connecting terminal 15 will be embedded in the carrier 5. This is to prevent the second current feeding conductor 10 from expanding outward or floating up at both ends from the carrier body so that the second current feeding conductor 10 will be held in a perfect ring shape and a rotatable contact with the later described current collecting conductor will be performed smoothly. While the lead connecting terminal 15 is provided so as to be connected with a lead of the current source cord in the present embodiment, the same can be omitted so that, for example, the lead may be connected directly to the inside surface of the second current feeding conductor 10 by soldering or welding. Further, it is desirable that, as shown in FIG. 2, the two lead wires respectively insulation coated of the current source cord 6 are knotted with each other to form a knot before embedded in the carrier 5 so that the connections between the cord and the respective feeding conductors will be prevented from being damaged due to any external pulling force given in the direction shown by an arrow F in FIG. 2 to the cord 6.

In FIG. 3, there is shown a state in which the current feeding conductor carrier 5 is assembled in the current collecting conductor carrier 8 so that both carriers are made to be the integral block 7. The current collecting conductor carrier 8 is a cylindrical vessel opened at one axial end while closed at the other end and is preferably formed of a transparent material of a plastic or the like so that the current conducting contact within the carrier 8 can be observed from outside.

A first current collecting conductor 21 and a second current collecting conductor 22 are inserted and fixed respectively in each of a pair of through holes 20 made in the closed end part of the carrier 8. Both current conductors 21 and 22 extend at inner end toward the open end of the carrier 8 and are provided with substantially U-shaped current conducting contact parts 21*a* and 22*a* respectively in their tip parts.

As shown in FIGS. 6 and 7, these current conducting contact parts 21*a* and 22*a* are resiliently fitted respectively to each of the current feeding conductors 9 and 10 so as to hold the respective conductors between their legs of the U-shape performing the electric contact and current collection. Further, as seen in FIGS. 2 and 3, the current collecting conductors 21 and 22 extend at the other outer end in the axial direction of the carrier 8 through the holes 20 to form load terminal parts 21*b* and 22*b* for connection with the load (not illustrated) of the electric device in the body 2. An example of the manner in which the current collecting conductors 21 and 22 are fixed in the through holes 20 in shown in FIG. 9, in which the conductor 21 and 22 is urged into the hole 20 so as to be held between projections 23 made on one side of the through hole 20 and the other side 24. Another example of this fixing manner is shown in FIG. 10, wherein the conductor 21 or 22 is urged to be curved in its width direction as held between projections 25 similar to projections 23 and a longitudinal center projection 26 made on the opposite side in the through hole 20, so that each conductor 21 or 22 will be positively secured in position as being prevented from being pulled out of or shifted in the hole.

Further, the current collecting carrier 8 is provided with a step part 16 in the form of a cut of the periphery in axial direction at a part adjacent and contiguous to the closed end of the cylindrical carrier body and, at the other open end, with an inward projection 17 along the peripheral part of the inside wall adjacent the open end. This projection 17 is fitted in the groove 4*a* in the sliding coupling member 4 so as to support the current feeding conductor carrier 5 slidably rotatably with respect to the current collecting conductor carrier 8. Further, the carrier 8 is provided at the open end with a plurality of longitudinal slits 19 extending for a proper length toward the closed end from the open end edge so that the conductor 8 will be easily fitted at the opened end side to the sliding coupling member 4 with a snap action provided by the slits 9.

A hole 27 for receiving the pin-shaped first current feeding conductor 9 of the feeding conductor carrier 5 is made substantially in the center of bottom wall of the closed end in the current collecting conductor carrier 8 so that the current feeding conductor 9 will be rotatably borne in this hole, thereby the current feeding conductor carrier 5 is borne for the rotation at two parts of the groove 4*a* in the sliding coupling member 4 and the first current feeding conductor 9 separated in the axial direction of the carrier 8 so that stable and smooth rotation of the carrier 5 inside the carrier 8 will be assured. Further, it is desirable to have the current feeding conductor 9 butted at the tip against the bottom of the hole 27 so that, even in case the carrier 5 is subjected to any external force given thereto in a direction shown by an arrow G in FIG. 2, the carrier 5 will be prevented from moving in inward direction toward the electric device and thus the mechanical strength of the rotary coupling of both carriers will be elevated.

Next, both of the carriers 5 and 8 thus coupled with each other through the coupling member 4 so as to be the integral block 7 but mutually rotatable manner about a common axis are incorporated in the electric device body 2 as shown in FIG. 2. The device body 2 comprises two split halves 2*a* and 2*b* and the integral block of the carrier 5 and 8 is housed in the body as held between these two halves 2*a* and 2*b*. Fixing ribs 28 and 29 for holding the peripheral edge of the closed bottom part of the current collecting conductor carriers 8 are formed respectively integrally on inside wall of the respective halves 2a and 2b to diameterally extend inward so that the carrier 8 of the current collecting conductors only will be held stationary within the body 2. In particular, inward end edge of the rib 29 on the body half 2b is made flat in the present instance, so as to engage the flat surface of the step part 16 made on the periphery of the current collecting conductor carrier 8, so that the body carrier 8 only will be prevented from rotating within the body 2 by the cooperation of the rib 29 of the device half 2b and the step part 16. Referring on the other hand to the current feeding conductor carrier 5, a peripheral projection 18 is formed in the opening 3 of the device body 2 with a certain amount of thickness within the thickness at the opening 3 of the device body 2, which projection 18 is fitted in the body fitting groove 4b in the sliding coupling member 4 so as to support the current feeding conductor carrier 5 slidably also with respect to the body 2. Thus the current source cord 6 integral with the current feeding conductor carrier 5 is made free to rotate with respect to the device body 2 and current collecting conductor carrier 8 stationary held in the body with the load terminal parts 21b and 22b led out of the current collecting conductor carrier 8 likewise held stationary for connection with the load within the electric device.

In the above embodiment, there is shown the current source cord 6 having two current feeding wires. However, the present invention is not limited to the structure for use with such cord but can be applied in the same manner to the other types of current source cord having a single core wire or a plurality of lead wires. In the case of a single core cord, for example, the first current feeding conductor 9 may be provided as a projection of an insulative material while the first current collecting conductor 22 is eliminated and the projection may be borne in the hole 27 in the current collecting conductor carrier 8 so that the projection will act as the rotary shaft of the carrier 5 and the electric contact can be made only by the second current feeding conductor 10 and second current collecting conductor 21.

According to the present invention, as the current feeding conductor carrier and current collecting conductor carrier are rotatably coupled with each other and the rotary current collecting means including the current conducting contact part is made a single block, properties of the rotary current collecting means alone can be confirmed without incorporating it in the electric device body and there is no trouble after the rotary current collecting means is incorporated in the electric device body.

According to the present invention, for the same reason as in the above and the reason that the current feeding conductor carrier and current collecting conductor carrier are free to couple with and separate from each other, the assembling workability is high and the repair is easy.

According to the present invention, as the current collecting conductor carrier is formed of a transparent material, the rotary contact of the current feeding conductor and current collecting conductor with each other can be observed from outside.

According further to the present invention, as the current feeding conductor carrier is supported by the two parts of the first current feeding conductor of said carrier and the sliding coupling member, the current conducting contact can be made stable.

What is claimed is:

1. An electric device having rotary current collecting means comprising a current collecting block which comprises an electric source cord, a first cnductor carrier for carrying an end part of said cord penetrating axially through said carrier and a current feeding conductor connected with the cord and a second conductor carrier having axial end parts, the second conductor carrier mounting a current collecting conductor brought into contact with said current feeding conductor of said first carrier, means for supporting the first carrier rotatably substantially at both axial end parts of said second carrier, and an electric device body including a load and housing therein said current collecting block, the body having means for engaging said second conductor carrier for holding it stationary, the first conductor carrier being rotatable therein.

2. The device according to claim 1 wherein said electric device body is provided with an opening at the rear end thereof for leading out said electric source cord, said first conductor carrier exiting from said second carrier at the end of the first carrier which is adjacent the end from which the cord is led out of the first carrier, said end of the first carrier being freely disposed in said opening of the device body so that the first carrier will be thereby supported in rotatable manner.

3. The device according to claim 1 wherein said electric device is provided with an opening at one end of the device body for leading out said electric source cord, said first carrier being provided at its periphery with a sliding coupling means adjacent the end thereof from which said electric source cord is led out, the first carrier being rotatably supported in said opening of the device body through said coupling means.

4. The device according to claim 1 wherein said second conductor carrier comprises substantially a cylindrical body open at one axial end and closed at the other end to provide a end wall of said cylindrical body, said end wall having a recess, said first conductor carrier leading said electric source cord out of one end and an axial projection at the other end, the first carrier being rotatably supported in the second in the second carrier adjacent said open end and at said axial projection by said recess in the end wall of the second carrier, the projection being inserted therein.

5. The device according to claim 1 wherein said cord includes a pair of conductor wires, said first conductor carrier comprising substantially a cylindrical body, said current feeding conductor of the first carrier comprising a first conductor of pin shape projected out of one end axially of said cylindrical body and connected with one of said conductor wires of the cord and a second current feeding conductor fixed onto the peripheral surface of the cylindrical body and connected with the other conductor wire of the cord, said second conductor carrier comprising substantially a hollow cylindrical body housing therein said cylindrical first carrier so that said pin shaped first conductor at said one end of the first carrier will be borne substantially at the center of an axial end of said hollow cylindrical body of the second carrier and the other end of the first carrier will be rotatably borne at the other axial end of the second carrier, said current collecting conductor of the second carrier comprising first and second conductors respectively fixed within the cylindrical body for slidable contact with respective said first and second conductors of the first carrier.

6. The device according to claim 3 wherein said slide coupling means has a first groove on the peripheral surface of the first carrier for engaging said opening of the device body in slidingly rotatable manner with respect to the device body and has a second groove adjacent said first groove for engaging said second carrier in slidingly rotatable manner with respect to the second carrier.

7. The device according to claim 3 wherein said slide coupling means is a member which is separable from said first conductor carrier.

8. The device according to claim 3 wherein said end of the first conductor carrier leading said cord therefrom extends out of said opening of the device body in a direction forming an angle with the axis of the device body.

9. The device according to claim 1 wherein said first and second conductor carriers are detachably secured to each other.

10. The device according to claim 3 wherein said second conductor carrier comprises a substantially hollow cylindrical body open at one axial end, and said open end of the second carrier snappingly engages said slide coupling means of the first conductor carrier so that the first and second carriers will be detachably coupled to each other.

11. The device according to claim 3 wherein said second conductor comprises a substantially hollow cylindrical body open at one axial end, said slide coupling means of the first carrier including a first groove for engaging with said opening of the device body in a rotatable manner and a second groove for engaging with said open end of the second carrier snappingly so that the first and second carriers will be detachably coupled to each other.

12. The device according to claim 4 wherein said second carrier is made of a transparent material for viewing of the first carrier and inspection of the electrical connections thereto.

13. The device according to claim 4 wherein said second carrier comprises a substantially cylindrical body having flat on its periphery, said device body being provided with a rib projecting inward from inner peripheral wall, said rib engaging said flat so as to prevent the second carrier from rotating with respect to the device body.

14. In an electric hand appliance or the like, the combination comprising a body formed of mated portions which together form a chamber having an access opening, a twistaccommodating line cord termination capsule in the form of a shell having an opening with a cylindrical rotor housed therein, the rotor having an outer end extending axially through the opening in the shell, the capsule being mounted in the chamber with the outer end of the rotor projecting freely through the acess opening, a line cord leading from the outer end of the rotor, the rotor being freely rotatable in the shell, an axial prong projecting axially from the inner end of the rotor, a slip ring on the rotor adjacent the prong, the prong and slip ring being electrically connected to the line cord, contact brushes stationarily mounted in the shall positioned to engage the prong and slip ring respectively for making slipping electrical contact therewith thereby to avoid twisting of the line cord when the appliance body is subjected to twisting movement, the brushes being electrically extended out of the shell to provide stationary electrical terminals for connection to the appliance.

15. The combination as claimed in claim 14 in which the line cord is led both axially and radially from the outer end of the rotor.

16. The combination as claimed in claim 14 in which the outer end of the rotor has an extension projecting outwardly of the body for conducting the line cord, the extension being angled dogleg fashion and providing mechanical advantage for rotation of the rotor by the cord and with respect to the body.

17. The combination as claimed in claim 14 including a cylindrical bushing interposed between the rotor and the shell being fixed to the bushing and the rotor being freely rotatable within the bushing.

18. The combination as claimed in claim 17 in which the bushing has an axially projecting portion fitted in the access opening and clamped between the mated halves of the body.

19. The combination as claimed in claim 17 in which the bushing has a detented snap connection with the shell and in which the bushing has an internal annular shoulder so that, in its snapped-on position, it encircles the rotor and holds it rotatably captive in the shell thereby forming a capsule subassembly.

20. The combination as claimed in claim 14 in which the shell has an inner end wall having an axial recess for pivoting engagement of the prong which projects from the inner end of the rotor.

* * * * *